United States Patent [19]

Kennedy

[11] 4,040,806

[45] Aug. 9, 1977

[54] PROCESS FOR PURIFYING HYDROCARBON GAS STREAMS

[76] Inventor: Kenneth B. Kennedy, Rte. 2, Box 343, Lee's Summit, Mo. 64063

[21] Appl. No.: 682,486

[22] Filed: May 3, 1976

Related U.S. Application Data

[63] Continuation of Ser. No. 218,884, Jan. 19, 1972, abandoned.

[51] Int. Cl.[2] ..... F25J 3/02

[52] U.S. Cl. ..... 62/28; 62/39

[58] Field of Search ..... 62/9, 11, 23, 24, 27, 62/28, 31, 32, 33, 34, 36, 38, 39, 42

[56] References Cited

U.S. PATENT DOCUMENTS

| | | | |
|---|---|---|---|
| 2,600,494 | 6/1952 | Ferro | 62/38 |
| 2,658,360 | 11/1953 | Miller | 62/38 |
| 2,765,635 | 10/1956 | Recay | 62/38 |

*Primary Examiner*—Frank W. Lutter
*Assistant Examiner*—Frank Sever
*Attorney, Agent, or Firm*—Lowe, Kokjer, Kircher, Wharton & Bowman

[57] ABSTRACT

An improved process for separating gaseous materials from a mixture containing the same. The process is particularly useful for the separation of high concentrations of nitrogen or similar low boiling materials from hydrocarbon streams such as natural gas and comprises the steps of first liquifying a portion of said gas stream and thereafter separating said stream into a gas phase and a liquid phase in a separation column. The overhead gas stream from the separation column is then passed through one or more turbo-expanders to provide process refrigeration and process energy. In one embodiment, at least a portion of the energy recovered is employed to drive a feed compressor. In a second embodiment, where the feed is at or near the required process pressure, the energy will be available for other purposes. In a third embodiment, where the feed is available at pressures above the required process pressure, the feed may also be passed through one or more suitable turbo-expanders to thereby provide additional process refrigeration as well as additional energy. In all embodiments, the process permits low cost purification. Moreover, depending principally upon feed composition and pressure, surplus energy and refrigeration will be available for other purposes. As will be readily apparent, this constitutes a definite economic credit and thereby permits an even lower cost purification.

2 Claims, 4 Drawing Figures

PROCESS FOR PURIFYING HYDROCARBON GAS STREAMS

This is a continuation application of Ser. No. 218,884, filed Jan. 19, 1972, now abandoned.

BACKGROUND

This invention relates to an improved method for separating certain gaseous components from a mixture comprising the same. More particularly, this invention relates to an improved method of separating low boiling gaseous materials from a gas stream comprising such materials and gaseous hydrocarbons.

As is well known in the prior art, the presence of high concentrations of low boiling incombustible constituents in hydrocarbon gases from natural reserves as well as other sources makes these gases unsuitable for use as fuels. As is also known, there are a large number of natural gas reserves throughout the world which remain virtually unexploited because these reserves contain high concentrations of such incombustible materials. As will be readily apparent, the increased demand for natural gas coupled with the decreasing reserves of high quality gas indicate a need for a process which will permit recovery and effective use of these reserves. It is, of course, essential that such a process permit a relatively high degree of resolution between the combustible and incombustible components, to thereby provide a significant increase in the fuel rating of these gases, as well as otherwise being economically attractive.

Heretofore, several processes have been proposed for separating incombustible materials such as nitrogen from hydrocarbon gases. In many such processes, separation has been effected by first liquifying either the combustible or incombustible components. In general, however, these processes are operative to remove only relatively minor concentrations of incombustible impurities and will not permit a significant increase in the fuel rating of the natural gas, especially when the incombustible component (or components) is present in high concentrations. Moreover, most of the prior art processes require external power and/or refrigeration to effect separation of even low concentrations of incombustible materials, and hence, are economically unattractive for the purification of hydrocarbon gases containing high concentrations of such impurities.

BRIEF DESCRIPTION OF THE INVENTION

It has now been found that the foregoing and other disadvantages of the prior art processes can be overcome by the method of the present invention and that high concentrations of low boiling, incombustible materials can be efficiently and economically separated from hydrocarbon gases. It is therefore an object of the present invention to provide an improved process for separating low boiling, incombustible materials from a hydrocarbon gas. It is another object of this invention to provide an improved process for separating low boiling, incombustible materials from a hydrocarbon gas stream which will provide a significant increase in the fuel rating of said gas stream when incombustible materials are, initially, present therein in relatively high concentrations. It is still another object of this invention to provide an improved process for separating low boiling, incombustible materials from a hydrocarbon gas which will permit a low cost separation of such components. It is yet a further object of the present invention to provide an improved process for separating incombustible materials from hydrocarbon gas wherein no external regrigeration will be required. It is an even further object of this invention to provide an improved process for separating incombustible materials from a hydrocarbon gas wherein external power requirements are minimized.

In accordance with the present invention, the foregoing and other objects and advantages are accomplished by first liquifying at least a portion of those hydrocarbons sought to be recovered in a higher state of purity contained in a gas stream comprising said hydrocarbons and one or more incombustible gaseous component and thereafter separating the partially liquified gaseous mixture, in a suitable fractionation column, into a gas phase containing a higher concentration of the incombustible gaseous component or components and a liquid phase containing a higher concentration of the hydrocarbon gas component or components. The refrigeration for partially liquifying the gaseous mixture is obtained by passing the gas phase from the fractionation column through one or more suitable turbo-expanders. When the gas feed is available at a pressure below that desired for the separation, at least a portion of the energy recovered with the turbo-expanders will be used to drive a feed compressor. When the gaseous feed is available at or just slightly above the pressure required for effective resolution, the energy from the turbo-expanders in the overhead gas stream will be used to drive one or more pumps in the process or for similar purposes. When the feed is available at pressures well above that required for effective resolution of the components, the gaseous feed will be passed through one or more suitable turbo-expanders to provide additional refrigeration for cooling and to provide additional power. As will become apparent from the disclosure set forth hereinafter, it is possible that both the refrigeration and power available will exceed that required in the operation of the process of the present invention.

DETAILED DESCRIPTION OF THE INVENTION

Figure 1:
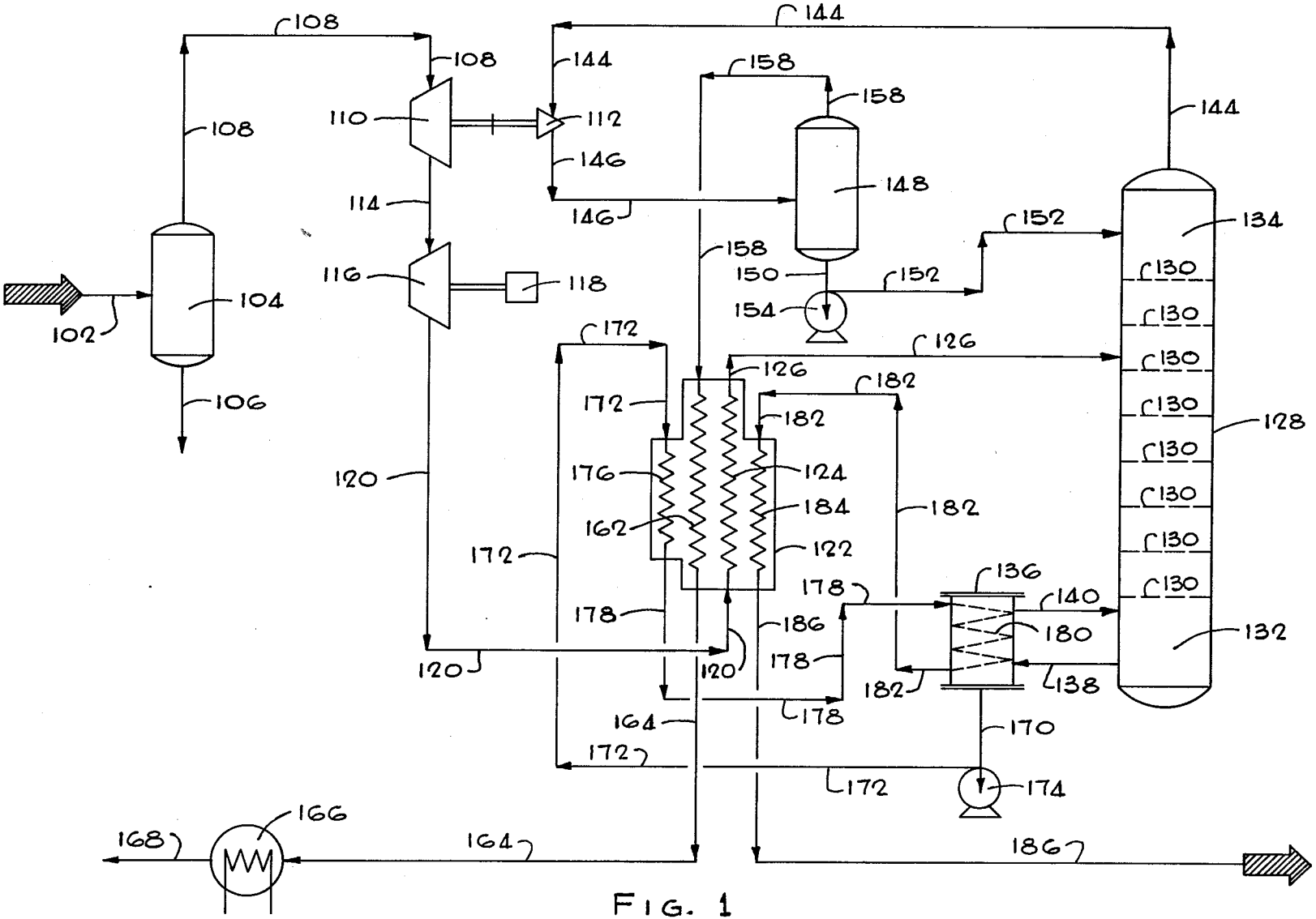
FIG. 1 is a flow diagram of a process within the scope of the present invention wherein the gaseous feed is available at a pressure below that required for an effective resolution of the gaseous component.

Broadly, the present invention relates to a method for separating a gaseous mixture into one or more lower boiling components and one or more higher boiling components. The method comprises the steps of first cooling the gaseous mixture to a temperature below the boiling point of the lowest boiling component to be separated from said mixture as a liquid and thereafter separating the partially liquified gaseous mixture into a gas phase and a liquid phase by passing the same into a separation column. Refrigeration for cooling the gaseous mixture will be obtained by passing the gas phase from the separation column through one or more suitable turbo-expanders. As will become more apparent from the disclosure set forth hereinafter, the amount of refrigeration objected by passing the gas phase through the turboexpander or expanders will depend, primarily, upon the volume of gas passed therethrough and the expansion ratio; i.e., the ratio of initial to final pressure, thereof. From this, it can be concluded that it is essential that the component or components to be separated in the gas phase be present in relatively high concentrations so as to insure an adequate volume of gas through the turbo-expander and that the separation be accomplished at elevated pressures so as to assure an adequate expansion ratio.

In general, the method of the present invention will be useful to separate any gaseous material or materials from any other gaseous material or materials when their respective boiling points are sufficiently different to permit liquification of one without the other. The method of the present invention is best suited, however, to the separation of one or more gaseous impurities from a gaseous mixture comprising the same wherein the boiling point of said impurities is at least about 20° F below the lowest boiling point of any other component of said mixture. The method of the present invention is particularly suited to the separation of impurities such as hydrogen, oxygen and/or nitrogen from hydrocarbon gases such as methane, ethane propane, etc.

In general, and has been noted, supra, essentially any gaseous feed may be separated into a liquid phase and a gas phase by the method of the present invention. It is, however, essential that the concentration of the component or components which are separated in the gas phase be relatively high in the gaseous feed mixture. The exact concentration will vary, of course, with the particular components involved and pressure energy available but, generally, these gaseous materials will be present in the gas feed mixture in an amount between about 25 and 80 mole percent. When the gaseous feed mixture comprises materials, such as water and carbon dioxide, which will solidify upon cooling, it will be advantageous to separate such materials from the feed by suitable pretreatment before cooling the same. Moreover, it will, generally, be advantageous to separate these materials at the lowest feed pressure. It follows, then, that it would be advantageous to effect the pretreatment before the feed gas is compressed to the process pressure when the feed is available below said process pressure, and to effect said pretreatment after the feed pressure is reduced when the feed is available at a pressure above the desired process pressure.

Following any pretreatment and pressure adjustment which may be required, the gaseous feed mixture is then cooled to a temperature below the lowest boiling point of any constituent to be separated in the liquid phase. This cooling is accomplished in a generally open refrigeration loop wherein the feed gas is contacted, indirectly, with a refrigerant obtained by expanding the overhead gas phase product from the separation column. Additional refrigeration may be obtained with the liquid phase product from the separation column. Moreover, reboiler heat may and generally will be obtained by passing all or a portion of the liquid phase product through the refrigeration unit and then into the reboiler.

After cooling the gaseous feed mixture to the desired temperature, the partially liquified mixture is then fed into a separation column. The column may contain one or more packed separation beds or one or more separation plates. The number of stages or plates will depend primarily upon the composition of the feed mixture and the efficiency of each stage or plate. The design of such columns is, of course, well within the ordinary skill of the art and forms no part of the present invention. As is well known, separation is effected as the liquid phase passes downwardly and the gas phase upwardly, each in intimate contact with the other. In general, the separation column will be designed and operated such that the material sought to be recovered as liquid product will be recovered in the desired purity without any significant loss thereof in the overhead gas stream.

Following separation of the gas mixture into an overhead gas phase product and a bottom liquid product, the overhead gas product is then passed through one or more suitable turbo-expanders and cooled to a temperature suitable for refrigeration and to provide sufficient liquid for reflux. At least a portion and generally all of the product from the overhead turbo-expanders which is not returned to the separation column as reflux is then passed through the gas feed refrigeration system. The overhead gas from the refrigeration unit may then be subjected to further treatment, recovered and used as is or discarded. Similarly, the liquid product may be recovered directly from the bottom of the separation column and stored, used for its intended purpose or subjected to further treatment as required. Moreover, when the liquid product contains more than about 3% ethane, propane or butanes, it will generally be advantageous to separate the materials and any heavier hydrocarbons from the lower boiling hydrocarbon components. In any case, however, at least a portion of the liquid product will generally be passed through the refrigeration unit to provide additional cooling of the feed gas and then through a reboiler to provide reboiler heat. It a preferred embodiment, the pressure of the liquid product will be increased to facilitate subsequent handling.

As will be readily apparent, reflux liquid may be provided at the top of the separation column in any one of several ways. For example, the overhead product, after passing through the turbo-expander, may be separated into a gas phase and a liquid phase and all or a portion of said liquid phase then returned to the upper portion of the column. Alternatively, all or a portion of the product from the overhead turbo-expander could be passed through a cooling coil or similar device to indirectly cool the overhead gas with the condensate being returned to the column as reflux. The former method is, however, preferred due to the increased efficiency associated therewith.

Having thus broadly described the present invention, it is believed that the same will become readily apparent by reference to the appended drawings. Referring then to FIG. 1, there is shown a flow diagram of a process for separating a gaseous feed mixture into a liquid phase portion and a gas phase portion wherein the gaseous feed mixture is available at a pressure below that desired for effective separation. As can be seen in the figure, a gaseous feed mixture, which mixture will generally comprise one or more hydrocarbons in a total concentration between about 20 and 75 mole percent and one or more non-hydrocarbon gases having a boiling point below said hydrocarbon components in a concentration between about 80 and 25 mole percent, enters through line 102. When required, the gas feed is pretreated to remove components which would otherwise freeze when subjected to the refrigeration required to partially liquify the gaseous feed mixture. In the embodiment illustrated, a knock-out drum 104 is provided to separate liquid constituents which are then removed from the knock-out pot through line 106. It will, of course, be appreciated that other means of separation could be employed such as passing the gas feed over a desiccant or a molecular sieve to selectively absorb the freezable components. The feed gas which is below the pressure desired for separation leaves the pretreating vessel through line 108—108 and passes through a first compressor 110, which compressor is driven by turbo-expander 112. The feed gas exits from the compressor 110 through line 114. In those cases where the gas feed pressure is relatively low, and hence, compressor 110 not adequate to increase the pressure thereof to the desired process pressure, a second compressor 116 will be provided. Generally, the second compressor, when required, will be driven by a suitable means such as motor 118. The feed gas leaves the second compressor at a pressure equal to the desired process pressure plus any pressure drop through the refrigeration unit through line 120—120 and enters refrigeration unit 122. In the refrigeration unit, the feed passes through passageway 124 wherein a portion of said gaseous feed mixture is liquified. In general, the gaseous feed mixture will be cooled to a temperature between about −150° and −250° F and essentially all of the hydrocarbons therein liquified. The partially liquified gaseous feed mixture leaves the refrigeration unit through line 126—126 and enters separation column 128. As illustrated, the separation column comprises a plurality of plates 130—130 and the partially liquified gaseous mixture enters the column just above the fifth such plate. As has been noted, supra, however, the number of plates and the point of feed introduction is not critical to the present invention, and methods known in the prior art may be employed to properly design a satisfactory separation column for a given feed composition and desired separation. Moreover, one or more packed separation sections could be substituted for the plurality of plates 130—130 which have been illustrated. Upon entry into the separation column, the liquid phase passes downwardly and accumulates in the lower portion of the separation column 132 whereas the gas phase passes upwardly into the upper section 134 of said column. From the lower section, the liquid phase then passes into reboiler 136 through line 138 wherein a portion thereof is vaporized and returned to the column through line 140. The overhead gas, on the other hand, is passed through one or more turbo-expanders, separated into a liquid phase and a gas phase and, in the embodiment illustrated, the liquid phase returned to the column as reflux.

In general, the separation column will be operable at any pressure below the critical pressure of both the overhead and bottom stream. In a preferred embodiment, however, the column will be operated as closely to the lower critical pressure as is consistent with good separation techniques so as to insure that the pressure of the overhead gas phase can be reduced sufficiently to provide all of the refrigeration required in the present process. The gas phase then passes overhead through line 144—144 at essentially the pressure employed to effect the separation and at a temperature generally between about −150° and −250° F. After leaving the separation column, the overhead gas is passed through a single turbo-expander (as illustrated) and its pressure reduced to at or near atmospheric pressure. In general, the reduction ratio will range between about 10 to 1 and 20 to 1. The overhead gas which is at least partially liquified as a result of the rapid expansion through the expander 112 leaves said expander throgh lines 146—146 generally at a temperature between about −250° and −350° F. The partially liquified overhead gas may then be passed directly to a cooling coil or similar device (not shown) when cooling of the overhead gas to produce reflux liquid is desired, or the same may be passed directly to the refrigeration unit and used to reduce the temperature of the gas feed mixture to the desired separation temperature. In a preferred embodiment, however, the partially liquified gas will be passed to knock-out drum 148 and separated into the liquid and gas phases respectively. The liquid phase will then be withdrawn through line 150 and at least a portion thereof returned to the separation column 128 as reflux through line 152—152 with pump 154. The gas phase, on the other hand, passes overhead from the knock-out drum 148 through line 158—158 to the refrigeration unit 122. In the refrigeration unit, the overhead gas or refrigerant passes through passageway 162 where as a result of indirect contact with the gaseous feed mixture, the gaseous feed mixture is cooled and the refrigerant heated. The refrigerant leaving the refrigeration unit through line 164—164 which generally will consist principally of a non-hydrocarbon gas and be in a higher state of purity than in the feed stream can then be recovered, used or discarded as desired. Moreover, since the refirgerant is at a relatively low temperature, the same may be used for further refrigeration such as by passing the same through heat exchanger 166 and thence away from the present process through line 168.

The liquid phase product, on the other hand, which is generally the product sought to be recovered in a higher state of purity may be withdrawn from either the lower portion of the separation column 132 or from the reboiler 136 and used directly for its intended purpose or subjected to further treatment as required. In a preferred embodiment, however, all or at least a portion of the liquid phase product will be withdrawn through line 170 and pumped to the refrigeration unit through line 172—172 with pump 174. As will be readily apparent, the pumping has the advantage of increasing the pressure of the liquid phase product while the same remains in a liquid phase. This is particularly advantageous where the liquid product is natural gas and increased pressure is required before the same can be transferred into existing pipeline facilities. Moreover, by passing all or a portion of said liquid product through passageway 176 in the refrigeration unit, sufficient heat will be imparted to effect the desired degree of reboiling within the reboiler 136. The liquid product is withdrawn from the refrigeration unit after passage through passageway 176 through line 178—178 and passed through heating coil 180 in reboiler 136. The liquid phase product is then withdrawn from heating coil 180 through line 182—182 and in a preferred embodiment will again be passed through refrigeration unit 122, this time in indirect contact with the gaseous feed mixture through passageway 184 so as to effect further cooling of the gaseous feed mixture and at the same time to increase the temperature of the liquid phase product. The liquid phase product is withdrawn from the refrigeration unit 122 after passage through passageway 184 through line 186—186. The liquid phase product may then be subjected to further treatment, such as fractionation to separate ethane, propane and/or other hydrocabon components therefrom in a manner described, infra, and illustrated in FIG. 4, or used directly for its intended purpose.

Figure 2:
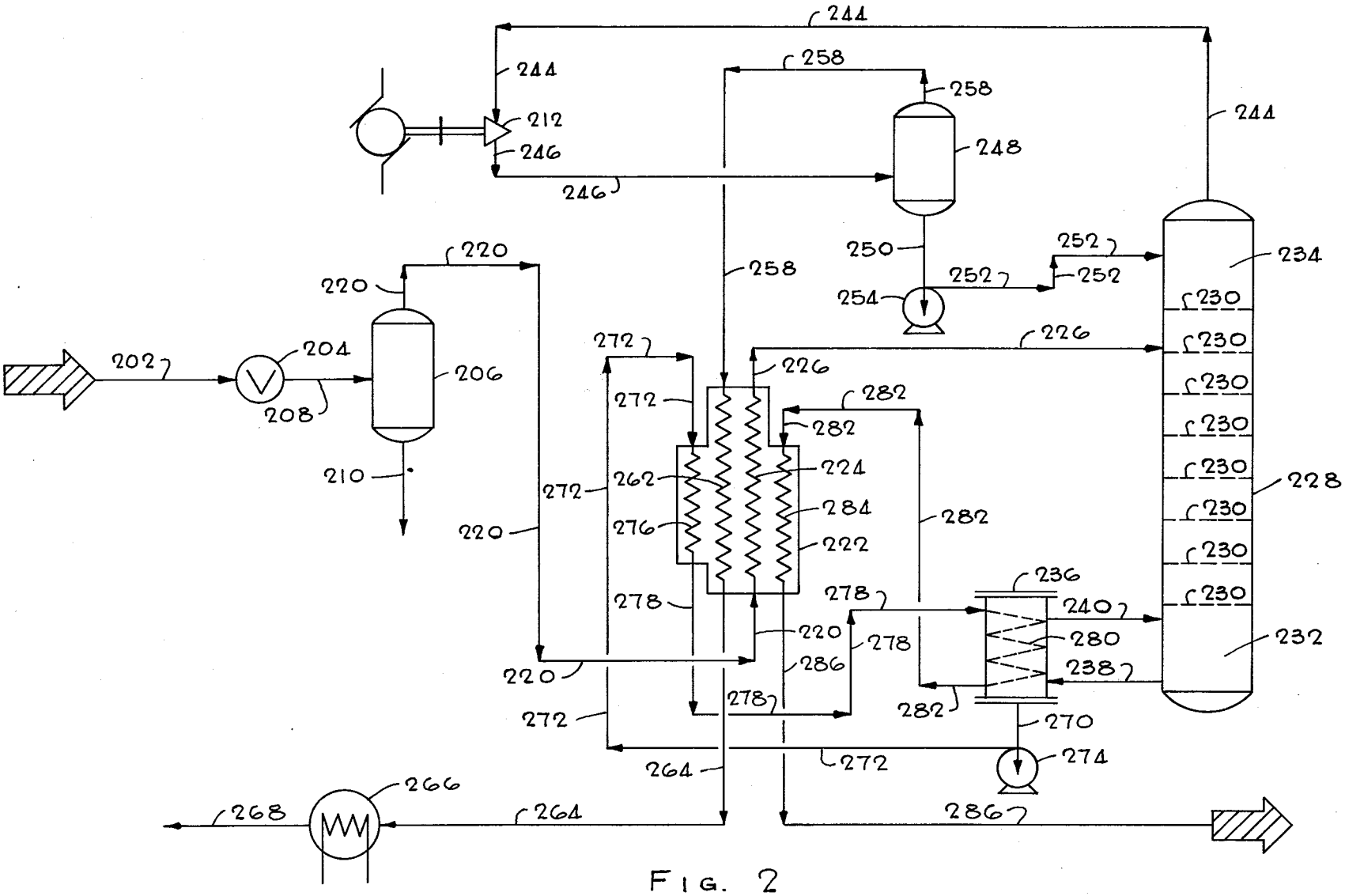
FIG. 2 is a flow diagram of a process within the scope of the present invention wherein the feed is available at a pressure equal to or just slightly above that required for effective resolution.

The method of the present invention exhibits even greater advantage when the gaseous feed mixture is available at a pressure equal to or only somewhat above the pressure desired for separation plus the pressure drop through the system. It is, however, necessary to modify the basic flow scheme since the inlet feed compressors are no longer required and the energy from the expander in the overhead gas product stream will be available for other purposes. Such a scheme is illustrated in FIG. 2. Referring then to FIG. 2, a suitable gas feed mixture is available through line 202. In general, the feed will be available at a pressure between about 200 and 675 psig, but in a preferred embodiment, said feed will be available at a pressure between about 350 and 450 psig when the present embodiment is employed. In those cases where the feed is available at a pressure greater than that equal to the desired separation pressure plus the pressure drop through the system, the feed will be passed through pressure reduction valve 204 and then to pretreating vessel 206 through line 208. Again, any suitable pretreatment may be effected at this point or this step may be omitted when not required. Where the only treatment required is to separate entrained liquids, pretreatment drum 206 will be a knock-out drum and the entrained liquid will be separated through line 210. The gaseous feed mixture then passes overhead through line 220 and into refrigeration unit 222. The gaseous feed mixture is then cooled to a temperature below the boiling point of the lowest boiling material to be separated in a liquid phase as it passes through said refrigeration unit in passageway 224 and is then fed to the separation column 228 through line 226. In the embodiment illustrated, the separation column comprises a plurality of plates 230—230. As has been noted, supra, however, one or more packed separation zones could be substituted for the trays. Again, the liquid phase passes downwardly and is accumulated in the lower section of said column 232 while the gas phase passes upwardly into the upper portion 234 of said column.

After separation into a gas and liquid phase, the two separate streams will be processed in a manner identical with that previously described. For example, the liquid phase may be passed into reboiler 236 through line 238 and a portion thereof vaporized and returned to the separation column through line 240. All or a portion of the remaining liquid may then be withdrawn from the reboiler through line 270 and passed to the refrigeration unit through line 272 with pump 274. On the first pass through the refrigeration unit, the liquid product is heated as it passes through passageway 276. From the refrigeration unit, the liquid product passes through line 278 and through heating coil 280 and reboiler 236. The liquid phase product then passes through line 282 and again through the refrigeration unit 222 through passageway 284. The liquid phase product then leaves the refrigeration unit through line 286 and may be used directly for its intended purpose or subjected to further treatment as desired.

As in the previous embodiment, the gas phase product passes overhead through line 244—244 and then through turbo-expander 212. As a result of passing through the expander 212, the pressure is reduced to a pressure at or near atmospheric and the temperature reduced to a temperature within the range of about −250° to about −350° F. Again, all or a portion of the overhead product from the expander may be passed directly to a cooling coil or similar device (not shown) or to the refrigeration unit or the same may be withdrawn from the expander through line 246—246 and passed through knock-out pot 248. In a preferred embodiment, however, the liquid portion of the overhead product will be withdrawn from the knock-out pot through line 250 and at least a portion thereof returned to the separation column 228 as reflux through line 252—252 with pump 254. The gas phase, on the other hand, is passed through the refrigeration unit via line 258—258. In the refrigeration unit, the gas phase or the refrigerant passes through passageway 262 and effectively cools the gas feed mixture as a result of indirect contact therewith. The overhead gas phase product leaves the refrigeration unit through line 264—264. Again, the overhead gas product may be used directly for any suitable purpose, subjected to further treatment or passed through a heat exchanger such as 266 to recover further refrigerating value. Generally, the partially liquid material will be converted to the gas phase as a result of passing through heat exchanger 266 and the final product from the unit in line 268 will be in the gas phase.

Since it is not necessary to compress the gas feed mixture when the same is available at a pressure equal to or above the desired process pressure, the energy from turbo-expander 212 may be used for other purposes such as driving generator 214. The energy available from the generator may then be used to drive pumps 254 and 274 and thereby further reduce the amount of external energy required to effect a separation by the method of the present invention.

Figure 3:
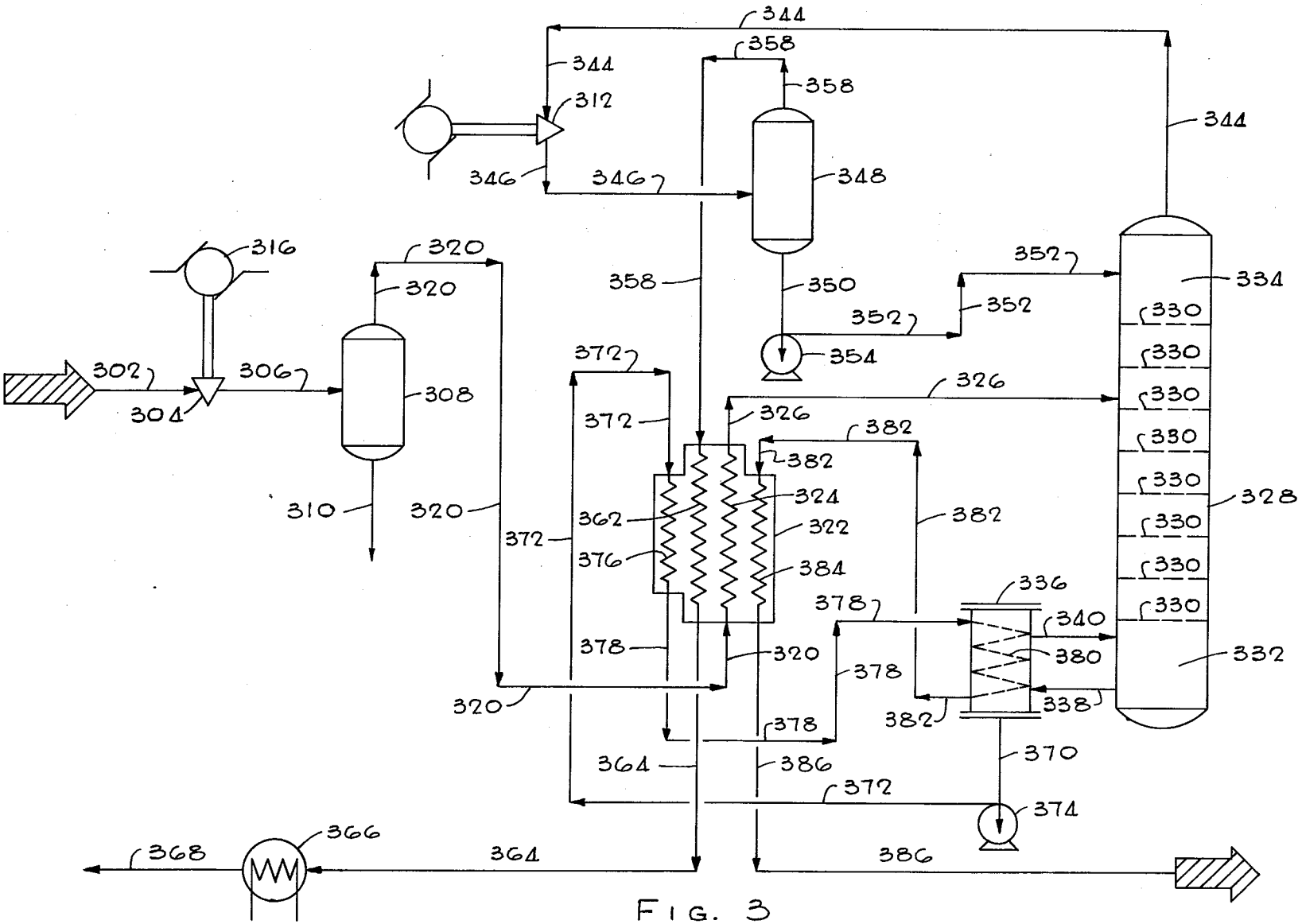
FIG. 3 is a flow diagram of a process within the scope of the present invention wherein the feed is available at a pressure well above that required for effective resolution of the gaseous components.

When the gaseous feed mixture is available at a pressure sufficiently high to warrant recovery of the energy contained therein; i.e., when an expansion ratio of at least about 1.2 to 1 and preferrably at least about 1.5 to 1, the method of the present invention exhibits still further advantages when compared to prior art methods. The method of this embodiment differs from that illustrated in FIG. 2 in that one or more turbo-expanders will be substituted for the pressure reduction valve 204. A schematic flow diagram of such an embodiment is illustrated in FIG. 3. Referring then to the figure, a gaseous feed mixture generally at a pressue above about 525 psig and preferably above about 675 psig is fed though line 302 to at least one turbo-expander 304. As a result of passing through the expander, the gas feed mixture pressure is reduced to the desired separation pressure plus any pressure drop through the system is then fed to pretreating vessel 308 through line 306. Again, any one of several pretreatments may be accomplished in vessel 308. In the simplest embodiment, however, entrained liquid will be separated such that the liquid is withdrawn through line 310 and the gas feed mixture passed overhead to refrigeration unit 322 through line 320—320. As can also be seen in the figure, the energy recovered from turbo-expander 304 is used to drive generator 316. In all other respects, the method illustrated in FIG. 3 is identical to that illustrated in FIG. 2, and hence, the same will be described only briefly herein.

As can be seen in the figure, the gas feed mixture passes through passageway 324 in the refrigeration unit and then to separation column 328 through line 326—326. Again, the separation column has been illustrated as comprising a plurality of plates 330 but, as is well known in the prior art, one or more packed separation zones could be substituted for said plates. After entering the separation column, the liquid phase passes downwardly and is accumulated in the lower portion 332 of said column. The gas phase, on the other hand, passes downwardly into the upper section 334.

In the embodiment illustrated, the liquid phase flows from the lower section 332 of said column to reboiler 336 through line 338. A portion of said liquid phase is then vaporized and returned to the column through line 340. All or a portion of the remaining liquid phase is then withdrawn from the reboiler through line 370 and passed respectively to the refrigeration unit through line 272—272 with pump 274, then through heating coil 380 in the reboiler through line 378 and then again to the refrigeration unit through line 382. On the first pass through the refrigeration unit, the liquid phase flows through passageway 376 and picks up all of the heat required for reboiling. On the second pass, the liquid phase passes through passageway 384 and picks up heat as the same cools the gas feed mixture. The purified product leaves the refrigeration unit through line 386—386 and may then be subjected to further treatment or used for its intended purpose.

The gas phase passes overhead through line 344—344 and through at least one turbo-expander 312. In the turbo-expander, the overhead as product is at least partially liquified and its temprature reduced significantly. In the embodiment illustrated, the overhead product flows from the turbo-expander to knock-out drum 348 through line 346—346. The liquid is then withdrawn from the knock-out drum through line 350 and, in the embodiment illustrated, is returned to the separation column 328 as reflux through line 352—352 with pump 354. The gas phase, on the other hand, leaves the knock-out pot through line 358—358 and is transferred to the refrigeration unit 322 therein. In the refrigeration unit, the gas phase or the refrigerant passes through passageway 362 and leaves the refrigeration unit through line 364—364. As also can been seen in the figure, the overhead product is then passed through heat exchanger 366 and exits in the gas phase through line 368.

As has been noted, supra, the liquid product from any of the aforedescribed embodiments may be subjected to further treatment for any one of several purposes, such as flashing to product a gas phase product and/or pumping or compression to produce a higher pressure product. In addition, the product may be subjected to further fractionation for the purpose of separating one or more valuable products therefrom. As has also been noted, supra, it will, generally, be advantageous to separate ethane, propane and/or butanes from the liquid product, when the same are present in an amount of at least 3%. This separation can be readily effected by the method illustrated in FIG. 4.

Figure 4:
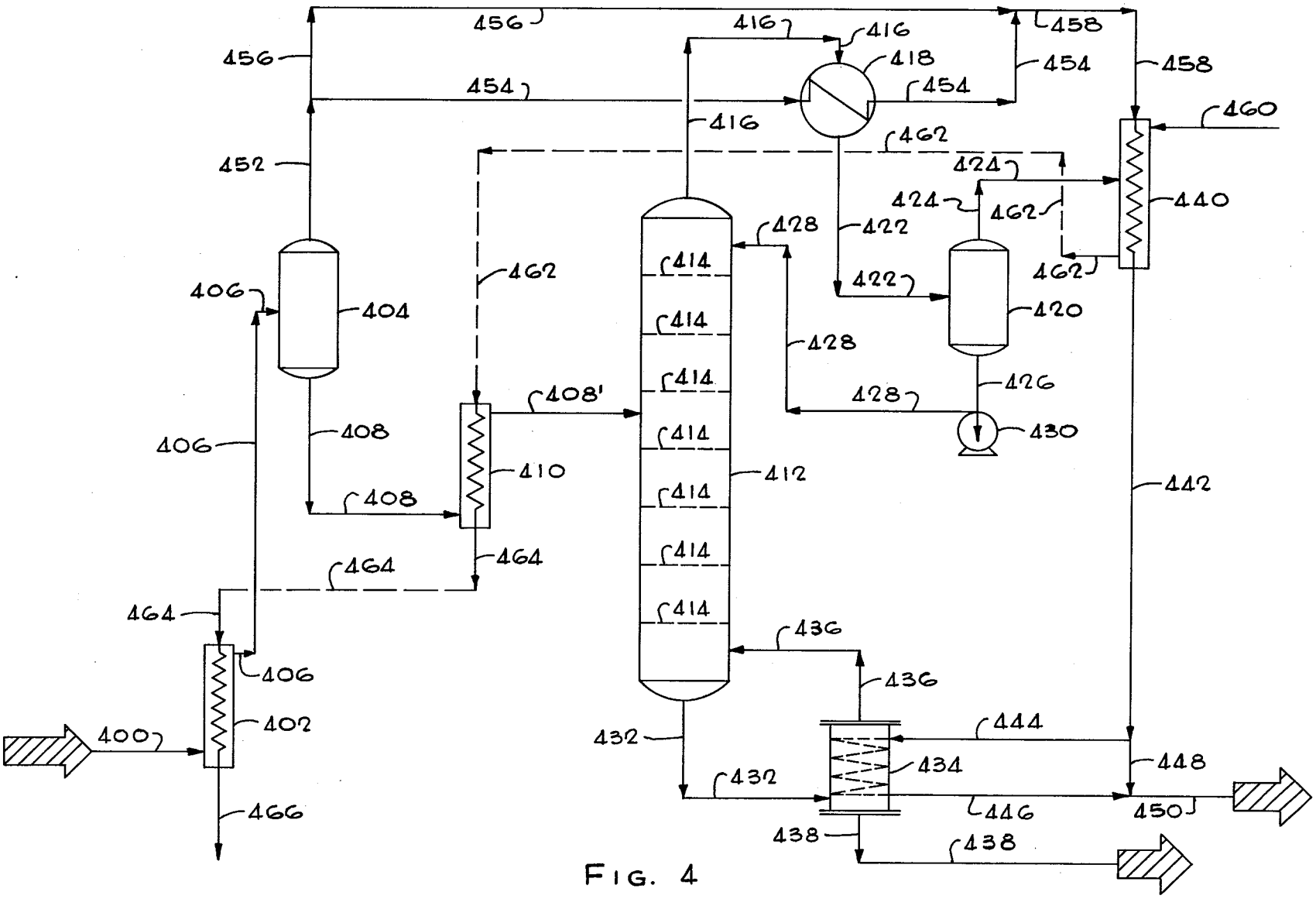
FIG. 4 is a flow diagram of a separation process suitable for the separation of lower boiling hydrocarbons.

Referring then to FIG. 4, the liquid phase product will be fed to a separation process through line 400. The liquid product is then preheated in heat exchanger 402 and passed to flash drum 404 through line 406—406. The liquid portion is then withdrawn from the flash drum through line 408—408, at leat partially vaporized in heat exchanger 410 and then fed to a suitable separation column 412 through line 408'. As illustrated, the separation column 412 comprises a plurality of tray 414—414. It will, however, be appreciated that one or more packed beds could be substituted for the trays 414—414.

After entering the column 412, the feed is separated into a gas phase and a liquid phase. The gas phase, which will consist principally of the lower boiling hydrocarbons, passes overhead while the liquid phase, which will consist principally of the higher boiling hydrocarbons, is withdrawn from the bottom of the column. Operation of the column in a manner to provide a split between any two hydrocarbon fractions such as the $C_2$ and lower hydrocarbons and the $C_3$ and higher hydrocarbons is, of course, well within the ordinary skill of the art and need not be discussed herein.

The overhead gas product from the separating column, which will, generally, consist principally of methane and contain any incombustible material carried over from the first separation, passes overhead through line 416—416 and then through condensor 418. The overhead stream then passes to a knock-out drum 420 through line 422—422 and is separated again into a gas phase product and a liquid phase. The gas phase, which is that portion of the original feed now having an enhanced fuel rating, is withdrawn through line 424,424. The liquid, on the other hand, is withdrawn through line 426 and at least a portion thereof is returned to the column as reflux, through line 428—428 with pump 430.

At the same time, the liquid product, which will generally consist principally of ethane, propane and/or butanes is withdrawn from the bottom of the column 412 through line 432—432 and passed through reboiler 434. In the boiler, a portion of the liquid product is vaporized and returned to the column through line 436—436. The remaining portion of the liquid is withdrawn as product through line 438—438 and may be used directly for its intended purpose or subjected to further treatment, such as fractionation to provide a still higher purity product.

The gas product from the knock-out drum 420 will, generally, be combined with the gas product from knock-out drum 404. In a preferred embodiment, the combined stream will then be heated, as in exchanger 440, and, at last a portion thereof, used to provide reboiler heat. When this embodiment is employed, the combined stream will leave the exchanger 440 through line 442 and at least a portion thereof passed to the reboiler 434 through line 444 and withdrawn therefrom through line 446. The withdrawn portion is the recombined with any material by-passed through line 448 and the gas phase product available, from the unit, through line 450. Again, the product may be used directly or subjected to still further treatment, as desired.

As shown in the figure, the flash product from knock-out drum 404 passed through line 452 and all or a portion thereof directed through lines 454 and 454'—454' and used as a coolant in condensor 418. The remaining portion by-passes the condensor 418 through line 456–456 and is recombined with coolant pressure in line 458—458.

As will be readily apparent, heat may be provided to each of the heat exchangers 402, 410 and 440 in anyone of several ways. In a preferred embodimet, however, the gas feed to the first separating column, either before any cooling or after partial cooling, will be used. When this embodiment is employed, the gas feed will first enter exchanger 440 through line 460 and subsequently pass to exchanger 410 through line 462—462 (shown partly broken) and to exchanger 402 through line 464—463. The gas feed is then withdrawn through line 466. In a most preferred embodiment, heat exchangers 402, 410 and 440 will be an integral part of the refrigeration unit used to cool the gas feed to the first separator.

PREFERRED EMBODIMENT

In a preferred embodiment, the method of the present invention will be employed to separate nitrogen from methane or a mixture of hydrocarbons comprising principally methane so as to enhance its fuel rating, and most preferably so as to produce a product having a fuel rating of at least about 1000 btu per standard cubic foot of gas. Preferably, the nitrogen will be present in the gaseous feed mixture at a concentration ranging between about 50 and 80 mole percent and the methane present in a concentration between about 20 and 50 mole percent. So that the amount of external energy required to effect the process of the present invention is minimized, it is also preferred that the gaseous feed mixture be available at a pressure of at least 300 psig. In this regard, it should be noted that the well-head pressure of most high nitrogen containing natural gas reserves would be at least 300 psig and these feed stocks are particularly peferred. Moreover, since these feed stocks generaly contain minor amounts of water in the vapor phase, they will, generally, be passed over a desiccant to avoid freezing in the refrigeration unit.

After the feed stock has been suitably pretreated, the same will be cooled to a temperature within the range of about −175° to about −225° F in the refrigeration unit and separated into a liquid phase and a gas phase in a separation column. All or a portion of the liquid phase will be passed through a reboiler and a portion thereof flashed and returned to the separation column. All or a portion of the remaining liquid product will then be passed, sequentialy, through the refrigeration unit wherein said liquid pahse will pick up all of the heat required for the reboiler, then through the heating coil in the reboiler and finally through the refrigeration unit a second time. In a most preferred embodiment, the presssure of the liquid phase product will be increased by pumping the same in the liquid phase. The product from the refrigeration unit will comprise at least about 75 mole percent hydrocarbon and have a fuel value of at least about 1000 btu per standard cubic foot of gas.

The gas phase, which will comprise principally nitrogen, will be passed through at least one suitable turbo-expander so as to reduce the pressure and temprature thereof. The selection of a suitable turbo-expander is, of course, well within the ordinary skill of the art and such expanders are available commercially. The expander or expanders should, of course, be sized such that the overhead product pressure is reduced to a pressure equal to atmospheric pressure plus the pressure drop through the remaining sections of the process. Moreover, it is important to the present invention that the reduction in presssure be accomplished with a high degree of efficiency with respect to recovery of energy from the expander. In a preferred embodiment, the overhead product will be cooled to a temperature between about −300° and −320° F and the liquid portion thereof returned to the separation column as reflux. The gas phase, on the other hand, will be passed through the refrigeration unit to provide all of the cooling required for the gas feed mixture. The nitrogen product from the refrigeration unit will then be passed through a heat exchanger so as to effectively recover additional refrigeration from said stream and to convert the same to the gas phase. The nitrogen product will, then, generally be vented to the atmosphere.

The following examples demonstate the effectiveness of the method of the present invention but are in no way intended to limit the same.

EXAMPLE 1

A gaseous mixture having the following composition:
Nitrogen: 58.8 mole percent
Metane: 27.5 mole percent
Ethane: 7.2 mole percent
Other lower hydrocarbons: 6.5 mole percent and available at the well-head of a high nitrogen containing natural gas reserve at a pressure of 315 psia could be treated by the method of the present invention to remove nitroen therefrom and to enhance the fuel value of the natural gas. Since the well-head pressure would be below the desired process pressure, an embodiment substantially indentical with that illustrated in FIG. 1 would be employed. Referring then to FIG. 1, the gaseous feed mixture available from the well-head would pass through line 102 and be contacted with a desiccant to remove moisture therefrom in pretreatment vessel 104. As will be readily appreciated, any flow rate, consistent with the piping and vessel sizes, could be used. The pretreated gas would then pass to a first compressor 110 through line 108.The pressure into said first compressor, which compressor is driven by turbo-expander 112 would be about 305 psia and the pressure out of the second compressor 116 about 420 psia. From the second compressor 116, the feed would then pass into refrigeration unit 122. Initially, there would be not cooling, unless external refrigeration were provided for start-up, and the entire feed stream would enter the separation column 128 in the gas phase. The entire feed would then be passed turbo-expander 112 and cooled to provide refrigeration to the refrigeration unit 122. As operation continues, increasing portions to the feed gas would be liquified, and at steady state, sufficient refrigeration would be provided to liquify at least at substantial portion of the hydrocarbons in the as feed. At steady state, then, the partially liquified feed mixtures would pass to the separation colunn 128 at a pressure of about 400 psia and a temperature of −200° F. In the separation column, the liquid phase would pass downwardly and into reboiler 136 which would be maintained at a temperature of about −189° F. The liquid product would then be withdrawn from the reboiler and passed successively through the refrigeration unit, the heating coil in the reboiler and the refrigeration unit. The pressure of the liquid phase product would be increased to 1000 psia by pump 174 and said product recovered at a temperature of −90° F. When the separation column has about 12 effective stages, the recovered bottom product would have a composition of 25.1 mole percent nitrogen, 49.3 mole percent methane, 12.9 mole percent ethane and the remainder other lower hydrocarbons. The fuel value of the product would be about 1000 but per standard cubic foot of gas.

At steady state, the overhead reflux would be operated at a temperature of −236° F and the gas phase overhead product withdrawn at a pressure of 398 psia and −224° F. The gas would be withdrawn from the column 128 and then passed through turbo-expander 112 and the pressure reduced to 35 psia and the temperature to −312° F. The liquid portion of the product from the turbo-expander would be returned to the separation column as reflux and the gas phase passed through the refrigeration unit 122. The overhead product from the refrigeration unit would be 98 percent nitrogen.

From the foregoing it will be readily apparent that the method of the present invention may be effectively employed to reject nitrogen or similar non-hydrocarbon gases from a hydrocarbon mixture comprising the same when the hydrocarbon is principally methane to improve the fuel value therof. In the example, the fuel value was increased from about 600 btu per standard cubic foot to 1000 btu standard cubic foot.

EXAMPLE 2

A gas mixture having the following composition:
Nitrogen: 58.0 mole percent
Methane: 27.6 mole percent
Ethane: 8.8 mole percent
Propane: 3.4 mole percent
Other hydrocarbons: 2.6 mole percent
and availabe at the well-head of a high nitrogen containing natural gas reserve at a pressure of 462 psia could be treated by the method of the present invention to remove nitrogen therefrom and then to recover a product stream having an enhanced fuel rating and a stream rich in propane. Since the feed gas would be available at a pressure slightly above that desired for nitrogen rejection in the method of the present invention an embodiment similar to that illustated in FIG. 2 would be employed.

Referring then to FIG. 2, the feed, available through line 202, would be treated to remove undesirable components and the pressure reduced such that the feed would be available in line 220—220 at a pressure of 450 psia. After passage through the refrigeration unit 22 and, at a steady state, the feed would enter separation column 228 through line 226—226 at a temperature of −200° F and a pressure of 440 psia. In the column, the feed would be separated into a gas phase, comprising principally nitrogen and liquid phase comprising principally methane.

The gas phase would pass overhead through line 244—244 at a temperature of −219° F and then through two turbo-expanders disposed in series (rather than a single expander, as illustrated). In passing through the expanders, the overhead gas stream would be cooled to −312° F and the pressure reduced to 30 psia. As a result, a portion of the gas stream would be condensed. The liquid portion would then be separated from the overhead stream in a knockout drum 248 and returned to the column as reflux. At the same time, the gas portion would be passed through the refrigeration unit to cool the gas feed and then venet to the atomosphere. The vented gas would have a composition of about 98.9 mole percent nitrogen and 1.1 mole percent methane.

The liquid phase, on the other hand, would be passed through reboiler 236 and a portion thereof vaporized and returned to the column. The remaining portion would be withdrawn as an intermediate product through line 270 at a temperature of −160.5° F and used to supply reboiler heat. This intermediate product, which would have a composition of about 57.2 mole percent methane, 17.8 mole percent ethane, 17.8 mole percent nitrogen and 7.2 mole percent propane, would then be fed to a separation column similar to that illustrated in FIG. 4.

Referring then to FIG. 4, the intermediate feed would be heated to a temperature of −100° F in a heater such as 402, which heater could correspond to passageday 284 in FIG. 2, and then flashed in a drum 404 to produce a gas phase and liquid phase material. The gas phase material, which would have a composition of about 20.9 mole percent nitrogen, 65 mole percent methane, 12.9 mole percent ethane and 1.2 mole percent propane, would pass overhead from the drum and be used to provide cooling in the overhead container 418 before being combined with the gas phase product from column 412. The liquid phase, on the other hand, would be withdrawn through line 408, heated to a temperature of 0° F and then fed to a separation column 412. In the separation column, the feed would be separated into a gas phase and liquid phase product. The gas phase material would pass overhead and through condenser 418. The condensate would be returned as reflux and the remainder of the stream combined with the as phase from drum 404 to yield a gas product having a composition of about 18.8 mole percent nitrogen, 59.6 mole percent methane, 19.2 mole percent ethane and 2.1 mole percent propane and a fuel rating of about 995 btu per standard cubic foot. Since the process feed was available at a presssure above that required, the energy from the overhead turbo-expanders could be used to drive compressors for the gas product stream. In this way, the pressure of the gas product stream can be increased, at least inpart, to normal pipeline pressure.

The liquid product withdrawn from the reboiler 434 through line 438, on the other hand, would have a composition of about 1.5 mole percent ethane, 51.4 mole percent propane, 37.1 mole percent butanes and 10 mole percent higher hydrocarbons. This stream would be suitable for fractionation to propane, butanes and natural gasoline.

Although the present invention has been described and illustrated by reference to particular embodiments, it will be readily apparent that the present invention lends itself to various modifications which will be obvious to those skilled in the art. Accordingly, reference should be made solely to the appended claims to determine the scope of the invention.

Having thus described and illustrated the present invention, what is claimed is:

1. A method for separating a non-combustible, nitrogen-rich gaseous feed mixture comprising nitrogen present in the amount of 50 to 80 mole percent and one or more hydrocarbons present in the total amount of 50 to 20 mole percent, into a nitrogen-rich overhead gas product and a combustible hydrocarbon-rich bottom liquid product, said method consisting of the steps of:

1. first cooling said gaseous feed mixture to a temperature below the lowest boiling point of any hydrocarbon present to be separated as a liquid product thereby providing a partially liquefied feed mixture;
2. distilling said partially liquefied feed mixture in a plural stage distillation apparatus so as to form an overhead gas phase and combustible, bottom liquid phase product richer in hydrocarbon then said gaseous feed mixture at a pressure below the critical pressure of both said overhead and bottom products;
3. passing the overhead gas phase directly from the distillation step (2) through turbo-expander means so as to provide an inlet/outlet pressure ratio of between10-1 to 20-1, said ratio being sufficient distillation step (2), in a quantity sufficient to enable recovery of said combustible bottom liquid phase product from said non-combustible feed mixture (4) thereafter using at least a porion of said overhead gas product as a refrigerant to cool the gaseous feed mixture.

2. The method of claim 1 wherein the gaseous feed mixture is a available at a pressure the desired process pressure and the pressure of said feed is increased by passing the same through a compressor driven by the turbo-expander in said overhead gas phase line.

* * * * *

UNITED STATES PATENT OFFICE

CERTIFICATE OF CORRECTION

Patent No. 4,040,806 Dated September 15, 1977

Inventor(s) Kenneth B. Kennedy

It is certified that error appears in the above-identified patent and that said Letters Patent are hereby corrected as shown below:

Column 14, lines 57 and 58, delete "between 10-1 to 20-1, said ratio being sufficient distillation step (2), in a quantity" and insert -- between 10-1 to 20-1, said ratio being sufficient to liquefy a portion of said overhead gas so as to provide an overhead gas product and a liquid reflux, and returning said liquid reflux to the distillation step (2) in a quantity --.

Column 14, line 64 should read:
"mixture is available at a pressure below the desired process"

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*